US005772133A

United States Patent [19]

Hall

[11] Patent Number: 5,772,133

[45] Date of Patent: Jun. 30, 1998

[54] FRAGMENT RECIRCULATING SHREDDER

[75] Inventor: John L. Hall, Tracy, Calif.

[73] Assignees: Darlene Hall, Edmond, Wash.; Wilburn E. Hall, Newport, Oreg.; Vern W. Hall, Kodiak, Ak.

[21] Appl. No.: 537,518

[22] Filed: Oct. 2, 1995

[51] Int. Cl.[6] ..... B02C 18/22; B02C 18/40

[52] U.S. Cl. ..... 241/74; 241/79.3; 241/222; 241/606

[58] Field of Search ..... 241/74, 79.3, 100, 241/222, 236, 606, DIG. 38

[56] References Cited

U.S. PATENT DOCUMENTS

| | | | |
|---|---|---|---|
| 3,931,935 | 1/1976 | Holman | 241/24 |
| 4,618,103 | 10/1986 | Wilson et al. | 241/41 |
| 4,809,915 | 3/1989 | Koffsky et al. | 241/36 |
| 4,824,028 | 4/1989 | Rota | 241/24 |
| 5,114,084 | 5/1992 | Yamaguchi et al. | 241/178 |
| 5,205,495 | 4/1993 | Garnier | 241/31 |
| 5,437,414 | 8/1995 | Hall | 241/74 |
| 5,660,340 | 8/1997 | Baughman | 241/74 |
| 5,683,041 | 11/1997 | Sewill et al. | 241/19 |

*Primary Examiner*—John M. Husar
*Attorney, Agent, or Firm*—Harris Zimmerman

[57] ABSTRACT

A revolving trommel situated adjacent to a shredder has an annular screen which intercepts oversized or elongated fragments in the outflow from the shredder for return to the shredder. A first fragment guide directs the shredder outflow into the trommel and vanes in the trommel lift the oversized fragments to another fragment guide which extends out of the trommel to the shredder intake. In the preferred form, the trommel rests upon and is turned by a motor driven flexible continuous belt which carries fragments that pass through the screen upward to an elevated discharge chute. The apparatus is particularly useful for fragmentizing sterilized medical wastes.

17 Claims, 4 Drawing Sheets

FRAGMENT RECIRCULATING SHREDDER

TECHNICAL FIELD

This invention relates to apparatus for shredding materials and more particularly to apparatus of that kind in which oversized or elongated fragments in the shredder outflow are sorted out and returned to the shredder intake.

BACKGROUND OF THE INVENTION

Shredders of the type used for fragmentizing waste materials may produce fragments of different sizes. Thin elongated objects may pass through a shredder intact if they enter the mechanism at certain points at certain orientations. This causes problems in the processing of certain kinds of waste.

For example, medical wastes from hospitals, clinics and the like contain objects of diverse sizes and shapes which may be infectious and some of which have potentially dangerous sharp edges or points. Such wastes are sterilized and then shredded prior to disposal of the wastes at a dump site. Shredding of the wastes enables greater compaction thereby reducing hauling costs and conserving space at the dump site. Hazardous "sharps" in the medical waste, such as hypodermic needles, surgical instruments and the like are reduced to harmless fragments. Shredding makes it evident to knowledgable handlers that the waste has been processed and avoids needless apprehension by others by making it unrecognizable as medical waste.

These objectives are not met to the most desirable extent if oversized fragments are present in the processed waste. Hypodermic needles, for example, are thin elongated objects of the above discussed kind that can on occasion pass intact through a shredder.

My prior U.S. Pat. No. 5,437,414 discloses shredding apparatus which addresses this problem by intercepting oversized or elongated fragments in the outflow from a shredder and returning the intercepted material to the shredder intake. In the apparatus of the prior patent, the shredder is encircled by an annular revolving trommel which has apertures through which small fragments may pass. The small fragments are intercepted by a curved guide which extends along the lower portion of the trommel in spaced apart relationship with the apertures. Cleats on the trommel carry the small fragments upward to an elevated discharge chute at one end of the curved guide. Larger fragments are carried upward and dropped into the shredder intake hopper by vanes on the inside of the trommel. The curved surface keeps thin elongated objects from passing completely through an aperture and thus such objects are also carried upward and returned to the shredder.

It would be advantageous to effect the above described operations without requiring encirclement of the shredder by a trommel. This would remove constraints on the size and positioning of components of the apparatus that are imposed by the need to fit the shredder and certain accessory components within the trommel. Access to the shredder intake would also be improved.

It would also be advantageous if fragments which have passed through the trommel apertures were carried to an elevated discharge point without being traveled along the curved guide as this would reduce abrasion of the guide.

The present invention is directed to overcoming one or more of the problems discussed above.

SUMMARY OF THE INVENTION

In one aspect, the present invention provides shredding apparatus which includes a revolvable annular trommel for intercepting large fragments of shredded material that exceed a particular size. The trommel has an inside surface at which the large fragments are collected and has an array of apertures through which smaller fragments can pass. The trommel also has a plurality of spaced apart vanes which project from the inside surface and which carry the intercepted large fragments upward as the trommel revolves. An arcuate member extends beneath the trommel and upwardly along the trommel in the direction of travel of the trommel in position to intercept the smaller fragments which pass therethrough and in position to guide the intercepted smaller fragments upward as the trommel revolves. The smaller fragments are released at an upper end of the arcuate guide. A shredder is disposed at a location outside of the trommel. A first fragment guide extends into the trommel from a location beneath the shredder outlet and a second fragment guide extends from a location within the trommel to a location above the shredder intake, the second fragment guide being positioned to intercept fragments which fall from the vanes.

In another aspect of the present invention, recirculating shredding apparatus includes a shredder and a revolvable trommel which receives fragments released at the shredder outlet. The trommel has spaced apart coaxial annular rim members and an annular screen extending therebetween. The screen has an array of apertures through which fragments of shredded material of less than a particular size can pass and has an inside surface at which larger fragments are collected. The trommel also has a plurality of vanes which project from the inside surface to carry the larger fragments upward for return to said shredder. A pair of support members are at opposite sides of the trommel and a pair of spaced apart rollers extend between the support members. A drive motor is coupled to at least one of said rollers and a continuous flexible belt extends around each of the rollers and extends therebetween. The trommel rests upon the belt between the rollers and is supported and turned by the belt.

The invention provides shredding apparatus which returns oversized and elongated fragments in the outflow of a shredder to the shredder intake. The shredder is situated outside of the revolving trommel which intercepts and recirculates such fragments and thereby avoids constraints on the size and positioning of components of the apparatus. Access to the region above the intake hopper of the shredder is not impeded by the trommel. In the preferred form of the invention, fragments which pass through the trommel are intercepted and carried to an elevated discharge chute by a moving belt which also supports and turns the tromel. Abrasion is reduced as such fragments travel towards the discharge chute in syychronism with the motion of the tromel and the belt.

The invention, together with further aspects and advantages thereof, may be further understood by reference to the following description of the preferred embodiment and by reference to the accompanying drawings.

DETAILED DECRIPTION OF THE PREFERRED EMBODIMENT

Figure 1:
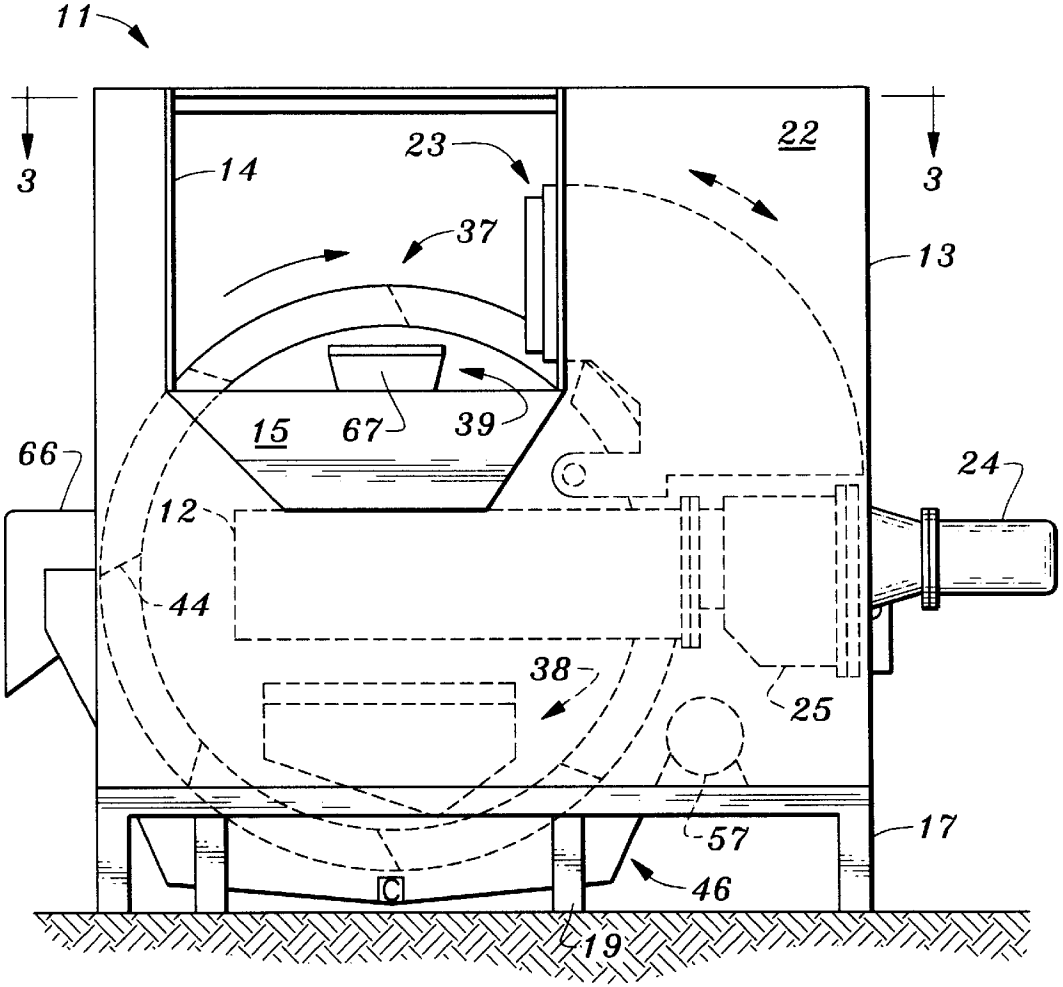
FIG. 1 is a front elevation view of shredding apparatus in accordance with the preferred emodiment of the invention.
Figure 2:
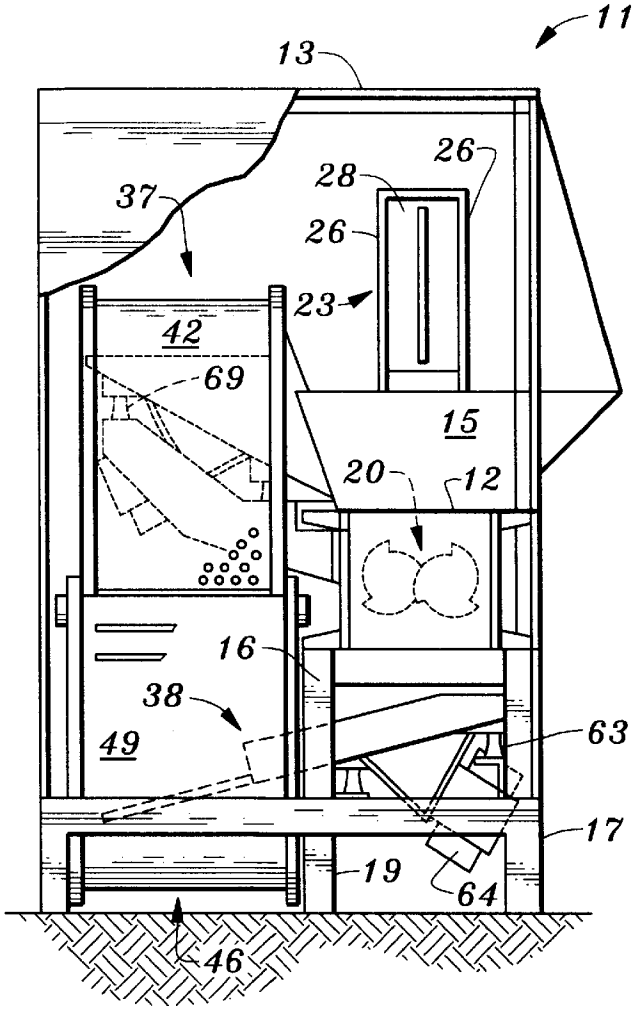
FIG. 2 is a broken out elevation view of one end of the shredding apparatus.

Referring initially to FIGS. 1 and 2 of the drawings, shredding apparatus 11 in accordance with this embodiment of the invention includes a shredder 12 situated within a housing 13 which has an opening 14 through which materials which are to be shredded can be loaded into the feed hopper 15 of the shredder. The heavy shredder 12 is supported by frame members 16 and the legs 17 which support the four corners 18 of the housing are supplemented by additional legs 19 in the vicinity of the shredder.

Figure 3:
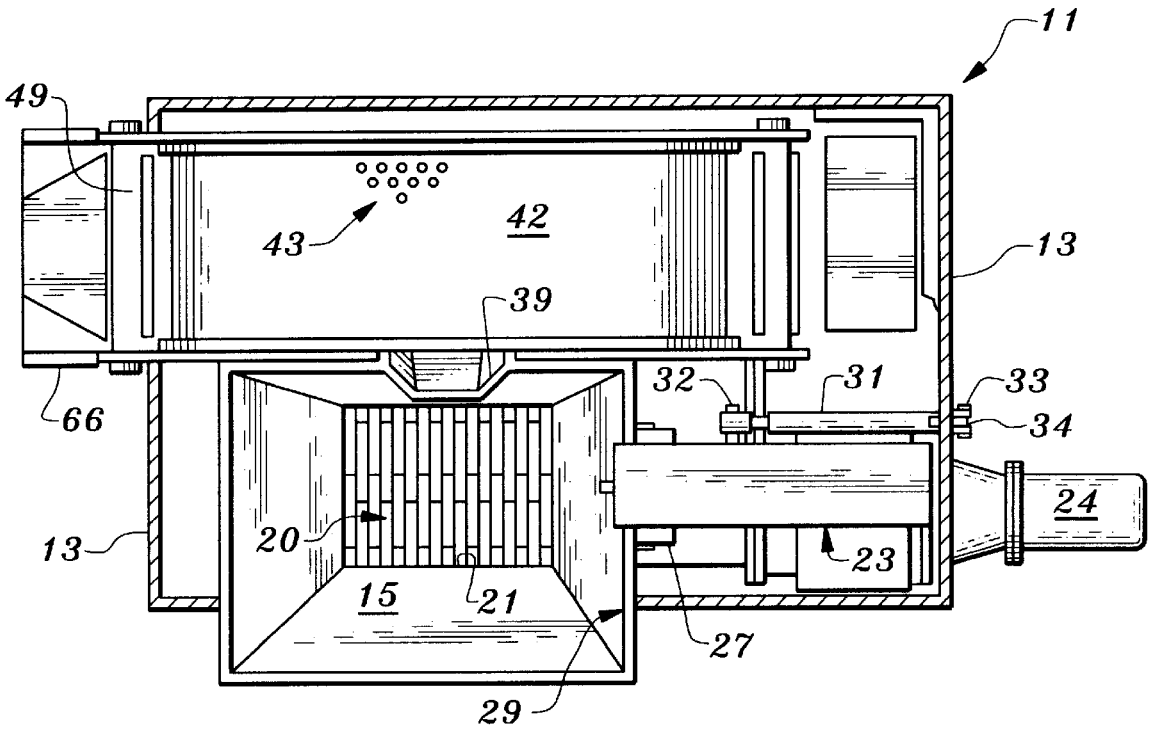
FIG. 3 is a plan section view of the shredding apparatus taken along line 3—3 of FIG. 1.

The shredder 12 may be of known internal construction and, with reference to FIGS. 2 and 3, is preferably of the type having two columns of interleaved cutting disks 20 situated below the shredder intake opening 21. The shredder is oriented to place the columns of cutting disks 20 in parallel relationship with the front wall 22 of housing 13 in order to accommodate to a pivoting feedstock ram 23.

The shredder 12 is driven by an electrical motor 24 through a speed reduction gearbox 25 which may be of known design. The feedstock ram 23 has side plates 26 which are coupled to the shredder 12 by pivot couplings 27. The side plates 26 are spanned by a ramming plate 28 which extends vertically at a location above an adjacent edge 29 of feed hopper 15 when the ram is at its retracted position. In operation the ram 23 is pivoted into feed hopper 15 by extension of a hydraulic actuator 31 which has one end coupled to the ram at a pivot coupling 32 and an opposite end coupled to a frame member bracket 33 by another pivot coupling 34. The pivot couplings 27, 32 and 34 are located to cause ramming plate 28 to be in a horizontal orientation at a location just above cutting disks 20 when actuator 31 is at full extension. A blade 36 projects from the centerline of ramming plate 28 to prevent objects from sliding out from under the plate and to aid in forcing the objects into the cutting disks 20.

Referring again to FIGS. 1 and 2 in conjunction, oversized and elongated fragments in the outflow from shredder 12 are intercepted and returned to feed hopper 15 by a revolving annular trommel 37 which is situated behind the shredder. A first fragment guide 38, which will hereinafter be described in more detail, extends into the lower region of trommel 37 from a location below the shredder outlet in order to deliver the shredder outflow to the trommel. A second fragment guide 39, which will also be further described, extends from the upper region of the trommel 37 to a location above the shredder intake in order to return oversized and elongated fragments to the shredder 12.

Figure 5:
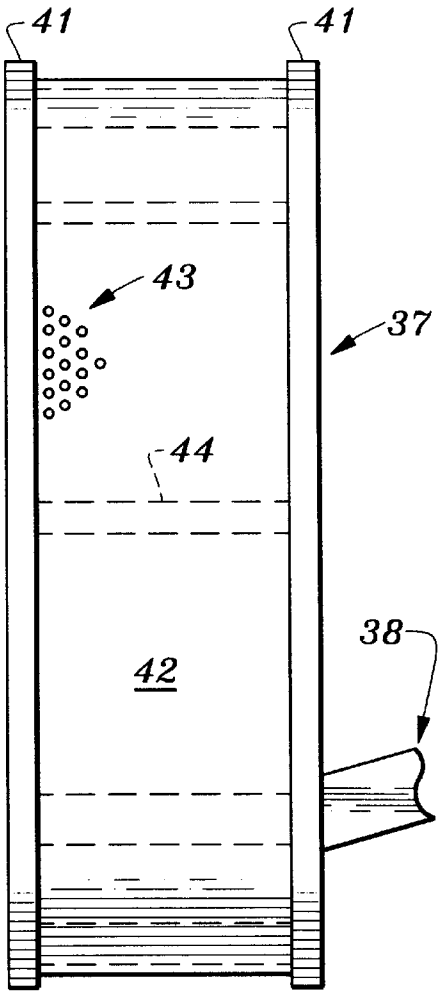
FIG. 5 is a side view of the trommel of the preceding figure.
Figure 4:
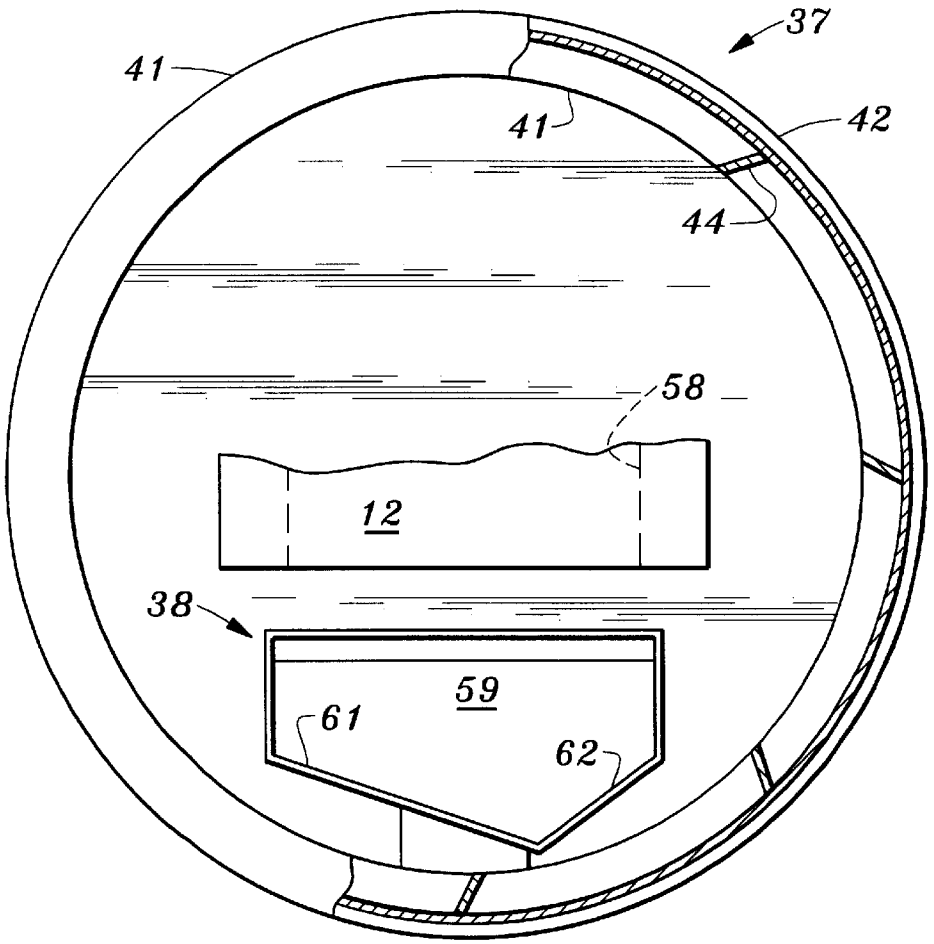
FIG. 4 is a broken out front elevation view of a trommel which is a component of the shredding apparatus.

Referring jointly to FIGS. 4 and 5, trommel 37 has spaced apart, annular rim members 41 between which an annular screen 42 extends, the rim members and screen being centered on the same axis. The screen 42 has a diameter which is smaller than the outer diameter of rim members 41 and larger than the inside diameter of the rim members. The screen has an array of apertures 43 which extends continuously around the screen to enable fragments of shredded material of less than a particular size to pass through the screen. The apertures may, for example, have a diameter of about one half inch in shredding apparatus designed for processing medical wastes. Other aperture sizes may be appropriate for other shredding operations.

Spaced apart vanes 44 project from the inside surface of the screen 42 and extend between rim members 41 at intervals around the inside surface of the screen. Each vane 44 is angled relative to the adjacent portion of screen 42 and inclines into the direction of rotation of the trommel in order to entrap and lift oversized fragments as the trommel revolves.

Figure 7:
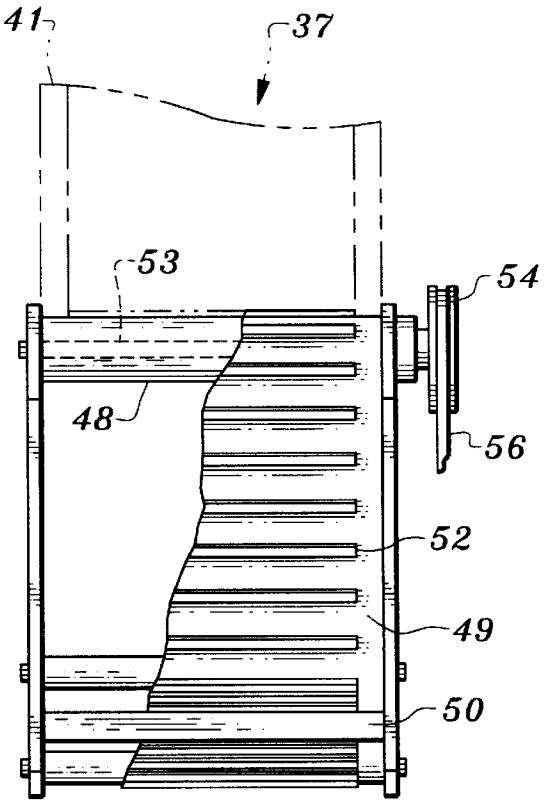
FIG. 7 is a side view of the trommel cradle of the preceding figure.
Figure 6:
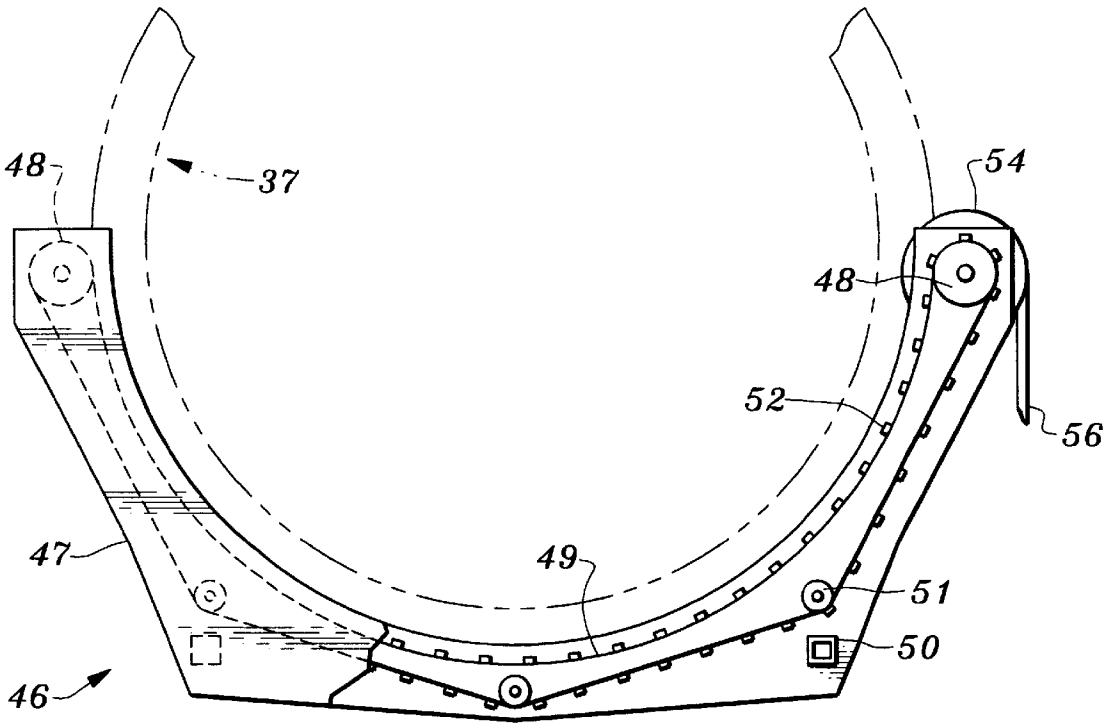
FIG. 6 is a front elevation view of a trommel cradle which is another component of the shredding apparatus.

Referring again to FIGS. 1 and 2, the trommel 37 is supported and turned by a cradle 46 situated below the trommel and behind shredder 12. Referring jointly to FIGS. 6 and 7, the cradle 46 has a pair of support members 47 which are spaced apart sufficiently to enable seating of the trommel 37 between the members and which are linked by cross members 50. A pair of spaced apart rollers 48 extend between the support members 47 at the top of the support members, the spacing of the rollers being sufficient to enable seating of the lower portion of the trommel between the rollers. The seated trommel 37 rests upon and is turned by a continuous belt 49 which extends around each roller and which extends therebetween. The belt 49 also travels around three idler rollers 51 at the bottom region of the support members 47. The weight of the trommel 37 causes the portion of belt 49 that is in contact with the trommel to assume the curvature of the trommel. The belt 49 is proportioned to be taut under that condition.

Belt 49 has spaced apart cleats 52 which extend transversely on the belt and which may be integral components of the belt. The cleats 52 do not extend completely across the belt 49 and are spaced apart from each edge of the belt sufficiently to enable the rim members 41 of trommel 37 to rest directly on the main body of the belt.

Rollers 48 have axles 53 which extend through support members 47 and one of the axles extends beyond the adjacent support member and has a pulley 54 engaged onto the axle. A drive belt 56 couples the pulley to an electrical drive motor 57 shown in FIG. 1. Referring again to FIGS. 6 and 7, rotation of pulley 54 by the drive motor travels the belt 49 around rollers 49 and thereby causes the trommel 37 to revolve in synchronism with the motion of the belt.

Referring jointly to FIGS. 2 and 4, fragments of shredded material which drop from the outlet 58 of shredder 12 are intercepted by the lower fragment guide 38 which extends into the lower region of trommel 37 and which slants downward in the direction of the trommel. The guide 38 has a flat floor 59 which has end edges 61 and 62 within trommel 37 that extend across the interior of the trommel in oblique relationship with the direction of travel of the underlying portion of the trommel. Consequently, fragments which slide down the guide 38 do not pile up at a small area but are instead more uniformly distributed across the width of the trommel.

Travel of the fragments down the guide 38 can be effected by gravity alone if the guide is sufficiently inclined. In some instances this can require that the shredder 12 be at an inconvenient height. Inclination of the guide 38 can be reduced by mounting the guide on resilient supports 63 and by securing a vibrator 64 to the underside of the guide.

Referring again to FIGS. 1 and 2, fragments of shredded material which are sufficiently small to pass through the screen 42 of trommel 37 are entrapped between the screen and belt 49. The motion of the belt then carries such fragments upward to a discharge chute 66 which is situated at the end of the belt. A wheeled cart or other receptacle may be placed below the discharge chute 66 to receive the processed material or the material may be moved to another location for further processing by a moving belt or other conveyer.

Fragments which are too large to pass through the trommel screen 42 are carried upward by vanes 44 and then drop into the upper fragment guide 39 when the motion of the trommel 37 turns the vanes into a sufficiently vertical orientation. The vane inclination at which fragments slide off the vane is somewhat greater than might be initially assumed as centrifugal force partially counteracts the effects of gravity.

The upper fragment guide 39 is a chute with a floor 67 which slopes down from the top region of the interior of trommel 37 to an opening 68, shown in FIG. 3, in the back wall of the shredder feed hopper 15. Thus the oversized fragments are returned to the shredder 12 for further shredding.

Referring again to FIG. 1, the guide 39 is preferably mounted on resilient supports 69 and has a vibrator 71 attached to its underside so that it need not be steeply inclined. Minimizing the inclination allows use of a more compact trommel 37.

Referring again to FIGS. 1 and 2, thin elongated objects such a hypodermic needles can enter into an aperture of the trommel screen 42 but are prevented from passing completely through the screen by the presence of the belt 49 a short distance away from the screen. Thus the elongated objects are carried upward by the motion of the trommel 37 and belt 49 in an orientation at which a portion of the elongated object is outside the trommel and another portion of the object is within the trommel. If the object is long enough to place its center of gravity within the trommel 37 it eventually drops into the interior of the trommel. The object is then caught by a vane 44 and carried upward to the point where it drops off of the vane and is returned to the shredder 12 in the manner previously described with respect to oversized fragments.

While the invention has been described with reference to a single embodiment for purposes of example, many variations and modifications of the shredding apparatus are possible and it is not intended to limit the invention except as defined by the following claims.

I claim:

1. Recirculating shredding apparatus comprising:

a revolvable annular trommel for intercepting large fragments of shredded material that exceed a particular size, said trommel having an inside surface at which the large fragments are collected and having an array of apertures through which smaller fragments can pass, said trommel further having a plurality of spaced apart vanes which project from said inside surface and which carry the intercepted large fragments upward as the trommel revolves;

an arcuate member extending beneath said trommel and upwardly along the trommel in the direction of travel of the trommel in position to intercept the smaller fragments which pass therethrough and in position to guide the intercepted smaller fragments upward as the trommel revolves, said arcuate member having an upper end at which the smaller fragments are released;

a shredder disposed at a location outside of said trommel and having an intake for receiving material to be shredded and an outlet for releasing fragments of shredded material;

a first fragment guide extending into said trommel from a location beneath said shredder outlet, and a second fragment guide extending from a location within said trommel to a location above said shredder intake, said second fragment guide being positioned to intercept fragments which fall from said vanes.

2. The apparatus of claim 1 wherein said trommel has a lower region situated at a location that is lower than said shredder outlet and wherein said first fragment guide includes a first chute which inclines upward from said lower region of said trommel to a location below said shredder outlet.

3. The apparatus of claim 2 wherein said first chute has a floor which extends into said lower region of said trommel, said floor having an end edge within said trommel that extends in oblique relationship with the path of travel of said trommel thereunder.

4. The apparatus of claim 2 further including a first vibrator coupled to said first chute.

5. The apparatus of claim 1 wherein said trommel has an upper region situated at a location that is higher than said shredder intake and wherein said second fragment guide includes a second chute which inclines downward from said upper region of said trommel to a location above said said shredder intake.

6. The apparatus of claim 5 wherein said shredder is situated in front of said trommel and has a hopper which extends upward from said shredder intake for receiving material that is to be shredded, said hopper having a back wall situated adjacent to said trommel and wherein said second chute opens into said hopper at said back wall thereof.

7. The apparatus of claim 1 wherein said trommel has an upper region situated at a location that is higher than said shredder intake and a lower region situated at a location that is lower than said shredder outlet, wherein said first fragment guide includes a first chute which inclines upward from said lower region to a location below said shredder outlet and wherein said second fragment guide includes a second chute that inclines downward from said upper region to a location above the shredder intake.

8. The apparatus of claim 1 wherein said trommel rests upon said arcuate member and is supported thereby.

9. The apparatus of claim 1 further including first and second parallel rollers disposed beneath said trommel at opposite sides of the axis of rotation thereof and a drive motor coupled to at least one of said rollers, said arcuate member being a portion of a continuous flexible belt that engages said rollers and extends therebetween.

10. The apparatus of claim 9 wherein said trommel has a rim which contacts said portion of said continuous belt and which is rotated by travel of said belt.

11. The apparatus of claim 9 wherein said trommel has an annular flange at each side thereof which flanges extend outward from said array of apertures and contact said portion of said belt, said belt having spaced apart transverse cleats which are proportioned to extend between said flanges.

12. The apparatus of claim 11 wherein said cleats are proportioned to contact said array of apertures when said cleats are between said flanges.

13. The apparatus of claim 9 further including a support member at each side of said trommel and wherein said first and second rollers extend between said support members, said support members and said rollers and said belt jointly forming a cradle which supports and turns said trommel.

14. The apparatus of claim 13 wherein said trommel has spaced apart coaxial annular rim members with outer edges that contact said portion of said belt and an annular screen which extends between said rim members in coaxial relationship therewith and in which said array of apertures is situated, said annular screen having a diameter which is smaller than the diameter of said outer edges of said rim members.

15. The apparatus of claim 1 wherein said shredder has two parallel columns of interdigitated cutting disks which columns extend in orthogonal relationship with the axis of rotation of said trommel, further including a ram which is pivotable about a horizontal axis that is parallel to the axis of rotation of the trommel, said ram being located to force material into said shredder intake.

16. Recirculating shredding apparatus comprising:

a shredder having an intake for receiving material which is to be shredded and an outlet for releasing fragments of the shredded material;

a revolvable trommel which receives fragments released at said shredder outlet, said trommel having spaced apart coaxial annular rim members and an annular screen extending therebetween, said screen having an array of apertures through which fragments of shredded material of less than a particular size can pass, said screen having an inside surface at which larger fragments are collected, said trommel further having a plurality of vanes which project from said inside surface to carry the larger fragments upward for return to said shredder;

a pair of support members which support members are at opposite sides of said trommel;

a pair of spaced apart rollers extending between said support members;

a drive motor coupled to at least one of said rollers for rotating the roller;

a continuous flexible belt extending around each of said rollers and extending therebetween;

wherein said trommel rests upon said belt between said rollers and is supported and turned by said belt.

17. The apparatus of claim 16 wherein said screen of said trommel has a smaller diameter than said rim members thereof and wherein said belt has a plurality of spaced apart transverse cleats proportioned to extend between said rim members where the rim members are in contact with said belt.

* * * * *